United States Patent [19]

Kirkland et al.

[11] 4,192,383

[45] Mar. 11, 1980

[54] OFFSHORE MULTIPLE WELL DRILLING AND PRODUCTION APPARATUS

[75] Inventors: Kerry G. Kirkland, Houston; Anthony J. Masciopinto, Humble, both of Tex.

[73] Assignee: Armco Inc., Middletown, Ohio

[21] Appl. No.: 902,255

[22] Filed: May 2, 1978

[51] Int. Cl.[2] ..... E21B 43/01; B01D 19/00

[52] U.S. Cl. ..... 166/341; 166/366; 405/203; 405/225

[58] Field of Search ..... 166/341, 365, 366; 175/7, 9; 405/203, 225

[56] References Cited

U.S. PATENT DOCUMENTS

| | | | |
|---|---|---|---|
| 3,552,903 | 1/1971 | Townsend, Jr. | 166/366 |
| 3,618,661 | 11/1971 | Peterman | 166/366 |
| 3,633,667 | 1/1972 | Falkner | 166/365 |
| 3,777,812 | 12/1973 | Burkhardt | 166/366 |
| 3,877,520 | 4/1975 | Putman | 166/366 |
| 3,987,638 | 10/1976 | Burkhardt et al. | 166/366 |

*Primary Examiner*—James A. Leppink

*Attorney, Agent, or Firm*—Roylance, Abrams, Berdo & Farley

[57] ABSTRACT

A modular multiple well drilling and production template structure is combined with a production riser base module to provide an underwater apparatus which allows a plurality of wells to be drilled, completed and produced by operations carried out from a single vessel or platform without remote installation of flowlines.

7 Claims, 11 Drawing Figures

OFFSHORE MULTIPLE WELL DRILLING AND PRODUCTION APPARATUS

BACKGROUND OF THE INVENTION

The drilling, completion and production of a plurality of wells in a single area under water has been accomplished in a number of cases in recent years. Thus, in the North Sea Argyll Field, a plurality of subsea satellite wells were installed in the vicinity of a subsea manifold station connected via a production riser to a semi-submersible surface vessel containing equipment for processing crude oil, the staellite wells being connected to the subsea manifold station by remotely installed flowlines. While such prior-art procedures, and the apparatus employed, have achieved considerable success, they have had a number of disadvantages, including the relatively high cost of drilling and completing satellite wells, the relative complexities arising from a plurality of unitary subsea installations, one for each satellite and one for the manifold station, and particularly the difficulties and cost involved in laying flowlines from each satellite well to the manifold station.

As an alternative approach to drilling a number of underwater wells independently, prior-art workers have proposed to employ templates including both means for establishing a plurality of wells, by drilling through the template, and means for connecting the completed wells to flowline portions carried by the template structure. Typical of such proposals are the apparatus disclosed in the following U.S. Pat. Nos.:

3,004,612: Kofahl
3,633,667: Falkner
3,877,520: Putman

Though such proposals have the advantage of concentrating the wellheads for a plurality of underwater wells in a small area, they provide little aid with respect to the problem of handling the fluid produced from the wells.

There has accordingly been a continuing need for improvement in both the overall approach to drilling, completing and producing multiple underwater wells and apparatus for accomplishing those ends.

OBJECTS OF THE INVENTION

A general object of the invention is to avoid the disadvantages inherent in drilling multiple underwater wells independently and then connecting each well to a manifold station spaced from the wells.

Another object is to devise multiple subsea well apparatus which eliminates the need for installation of flowlines by remote operatiions or operations carried out with diver assistance.

A further object is to decrease the cost of drilling, completing and producing a plurality of underwater wells in common location.

SUMMARY OF THE INVENTION

According to the invention, independent drilling and production template modules and a riser base module are prefabricated and shipped to an on-shore site where they are assembled to the desired complete template form, which includes the riser base module and at least one drilling and production template module secured rigidly together. Each drilling and production template module comprises a rigid frame structure on which is mounted at least one aperture-defining member and, for each such member, a flowline landing hub. The module is constructed to be landed on, e.g., the ocean floor, in horizontal position and when so positioned presents the aperture-defining member in a position to be entered by well drilling tools. The flowline landing hub is upright and located beside the corresponding aperture-defining member. Typically, each template module carries two aperture-defining members and two flowline landing hubs. Each template module is equipped with upright guide posts, typically four posts for each aperture-defining member, so that drilling equipment and ultimately a wellhead can be lowered into place on the template by the usual guide lines extending from the vessel to the template.

The flowline landing hubs have vertical flow passages and these are connected to upright connector hubs on the riser module, such connection being by piping installed when the template module or modules and the riser module are secured together preparatory to forming the complete template assembly, preparatory to transfer of that assembly to the drilling site. Transfer to the drilling site can be accomplished with a barge, or by attaching buoyancy chambers and towing the template assembly to the site. On site, the template assembly is lowered into position on the floor of the body of water and is then levelled. The riser module is equipped for connection of a pipe line to communicate with, e.g., a conventional single buoy mooring system for delivery of product, and the pipe line can be connected to the riser module before the template assembly is lowered into place.

Drilling is carried out conventionally, advantageously from the vessel which is to be used as the production station. Depending upon the circumstances, all of the wells may be drilled directionally, or only some may be directionally drilled. Each well can be completed, immediately after drilling, by simultaneously landing both a Christmas tree and a flowline connector which is connected to the flow passages of the tree and which lands on the flowline landing hub and is locked thereto.

The production riser assembly, including a manifold having guide means cooperating with guide posts on the riser base module, is then lowered and landed on the riser base module. The riser assembly manifold includes conduits which connect to the flowline connector hubs on the riser base module so that landing of the riser assembly places the flow conduits of the wellhead or wellheads in communication with the processing equipment on the surface vessel used as the production station. The manifold also includes a product delivery conduit which connects to a suitable connector on the riser base module to place the product delivery conduit in communication with the pipeline leading from the riser base module to the single buoy mooring or other gathering point.

IDENTIFICATION OF THE DRAWINGS

In order that the manner in which the foregoing and other objects are achieved according to the invention can be understood in detail, one particularly advantageous embodiment thereof will be described in detail with reference to the accompanying drawings, which form a part of the original disclosure of this application, and wherein.

DETAILED DESCRIPTION OF THE APPARATUS

Figure 1:
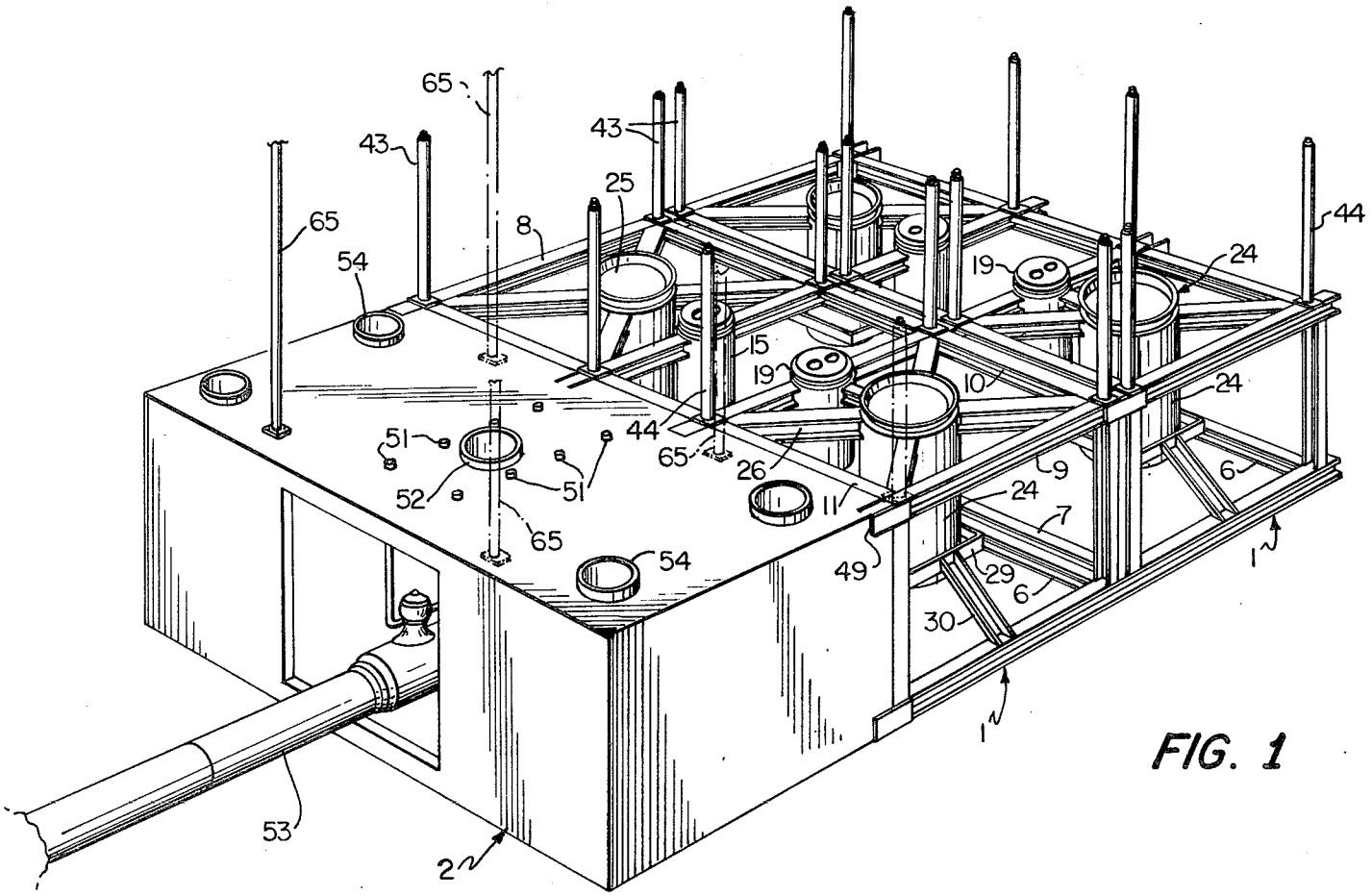
FIG. 1 is a perspective view of apparatus according to the invention in place on the floor of a body of water, the apparatus comprising two template modules and a riser base module.
Figure 2:
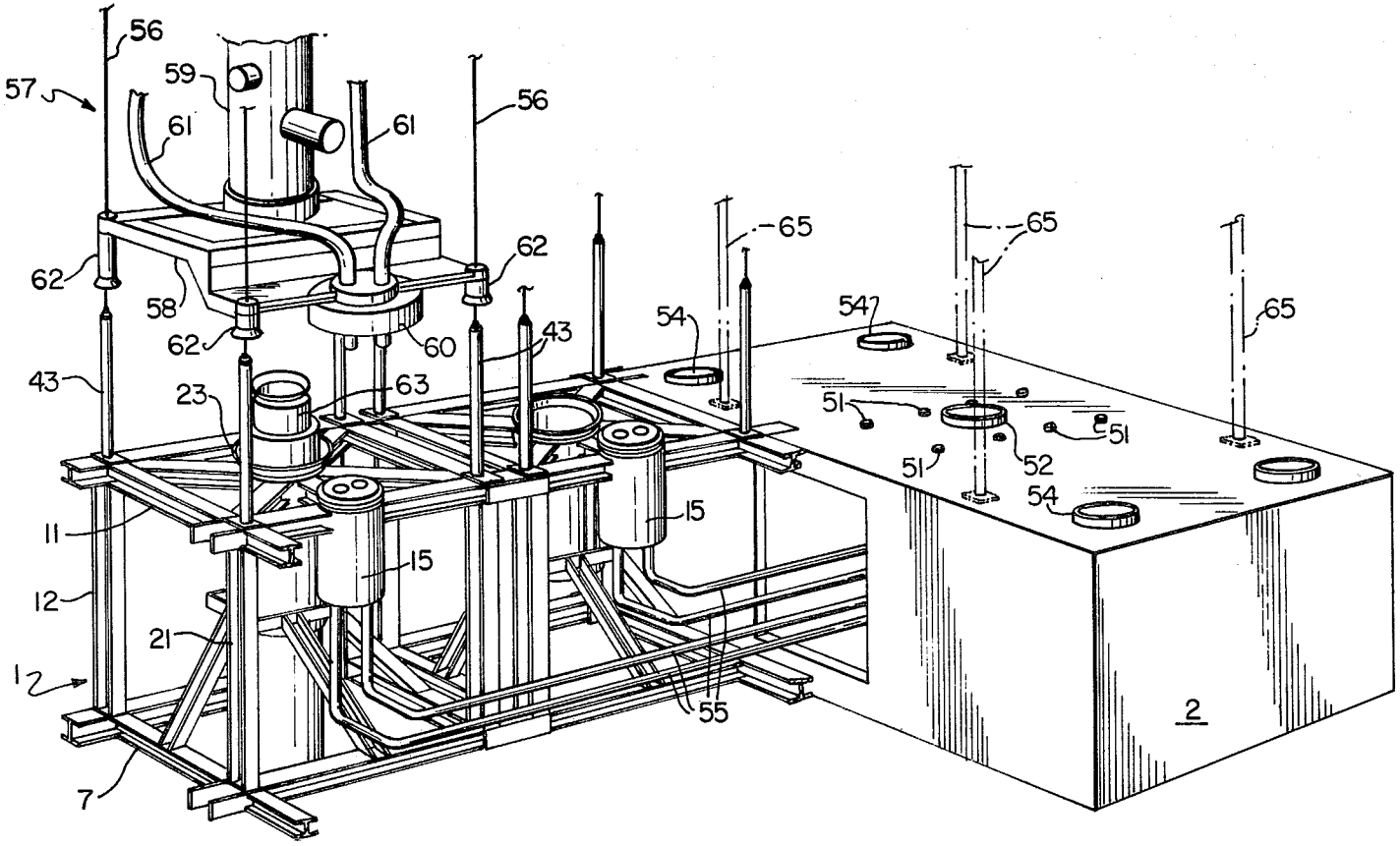
FIG. 2 is a perspective view of the apparatus of FIG. 1, with parts broken away for clarity of illustration, showing a Christmas tree being landed after a first well has been drilled.
Figure 3:
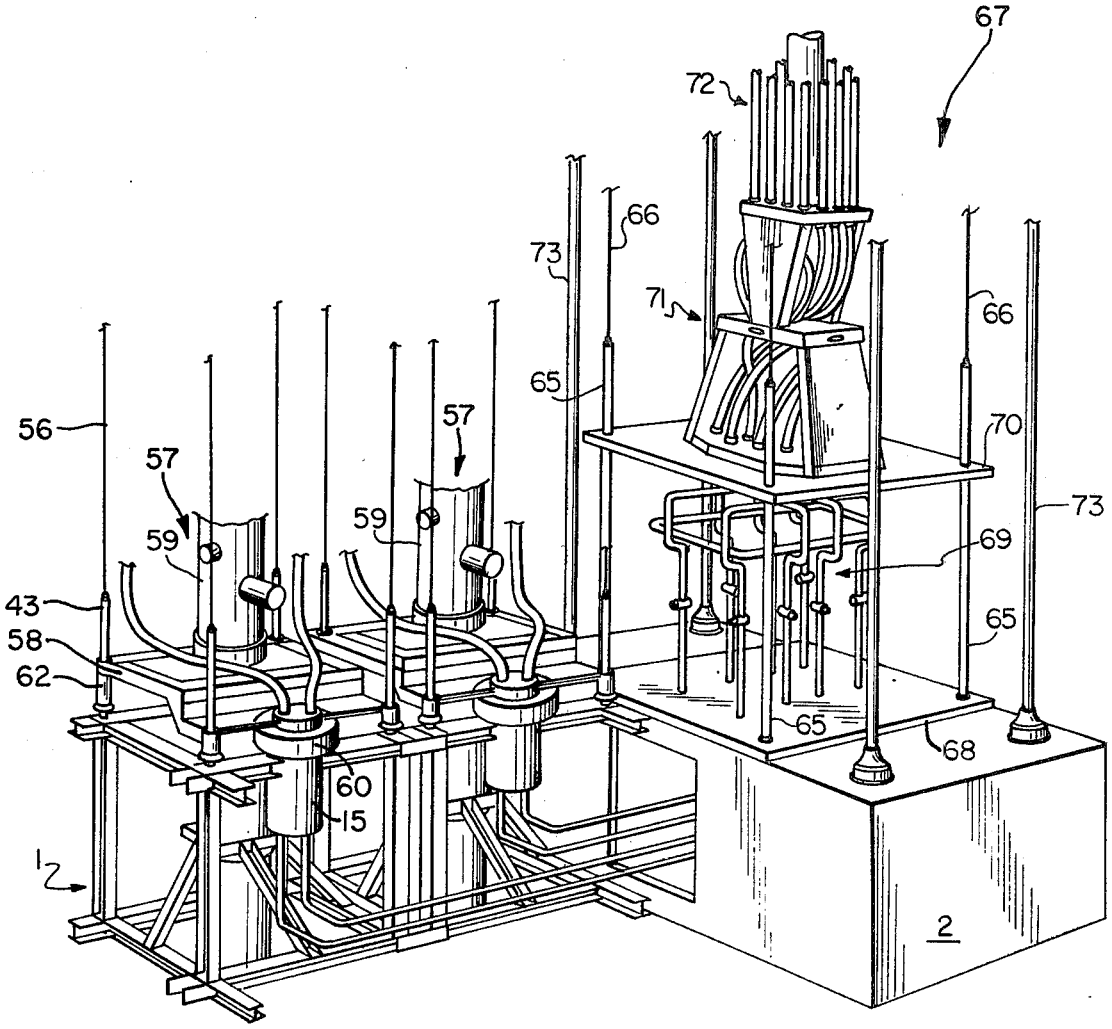
FIG. 3 is a perspective view similar to FIG. 2 showing the production riser in place.

As seen in FIG. 1, apparatus according to the invention comprises one or more drilling and production template modules 1 and a riser base module 2 rigidly secured together to form a unitary assembly installed directly on the floor of the body of water in which a plurality of wells are to be drilled. Each template module 1 is constructed for use in drilling two wells and as many template modules can be employed as is required for the number of wells to be drilled. In FIGS. 1–3, the assembly is illustrated as embodying only two template modules 1 for simplicity of illustration.

Figure 4:
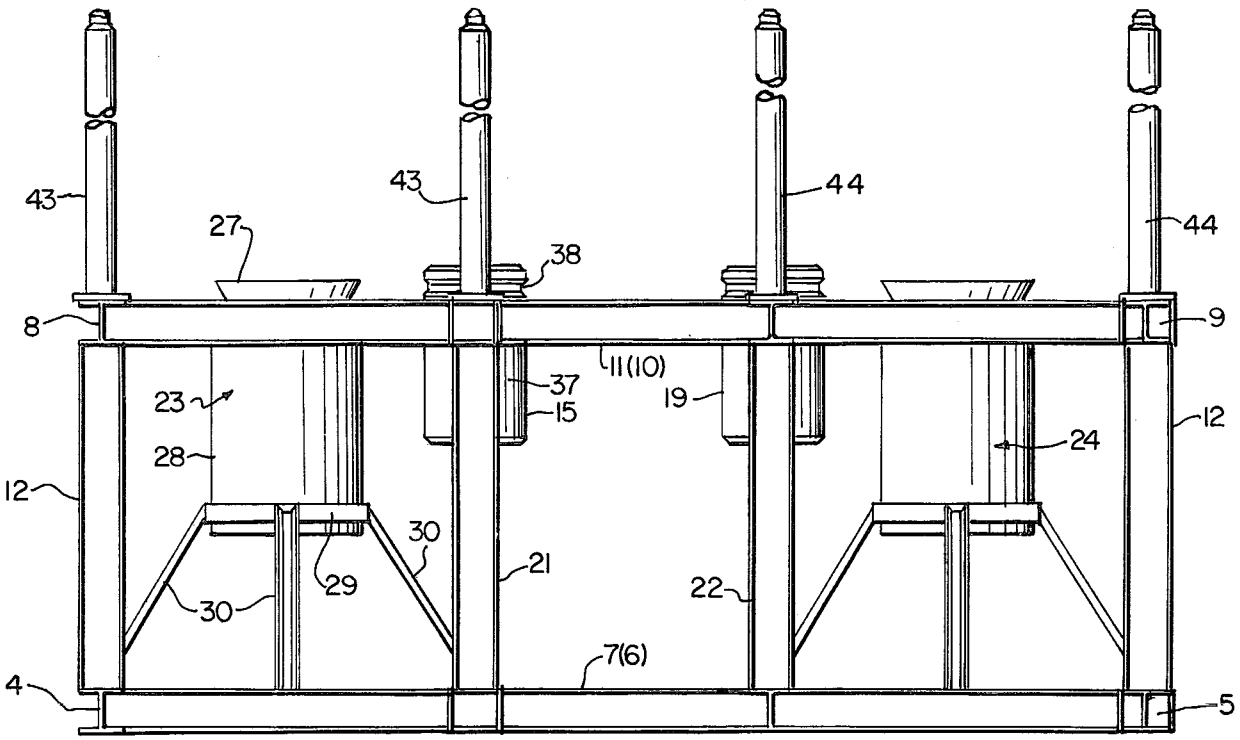
FIG. 4 is a side elevational view of one of the template modules of the apparatus of FIGS. 1–3.
Figure 5:
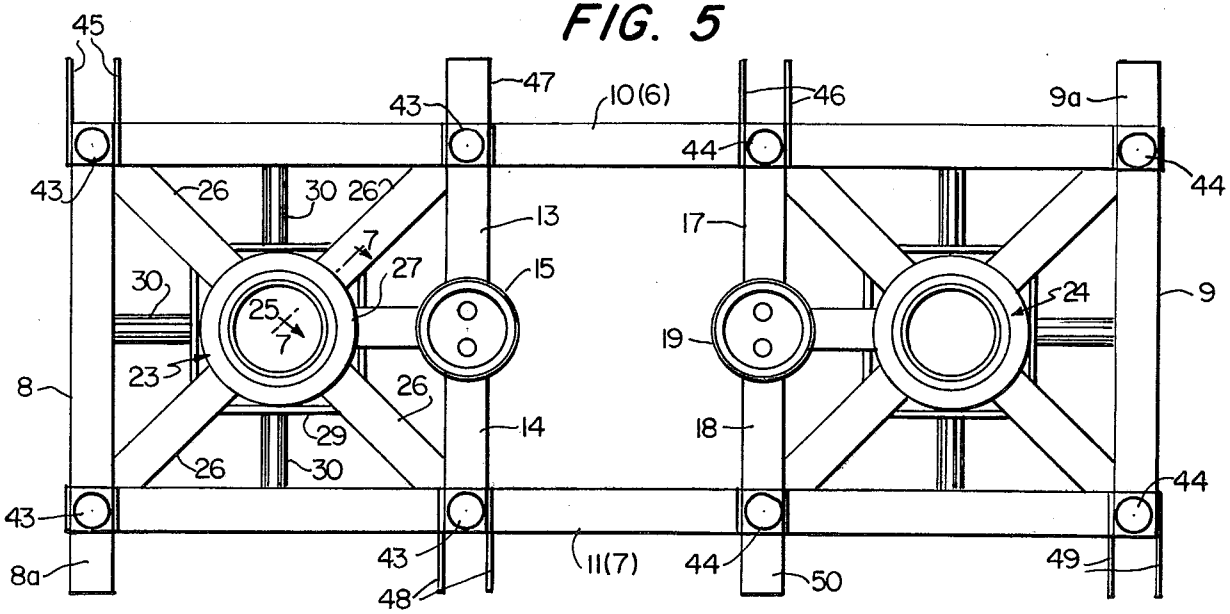
FIG. 5 is a top plan elevational view of the template module of FIG. 4.
Figure 6:
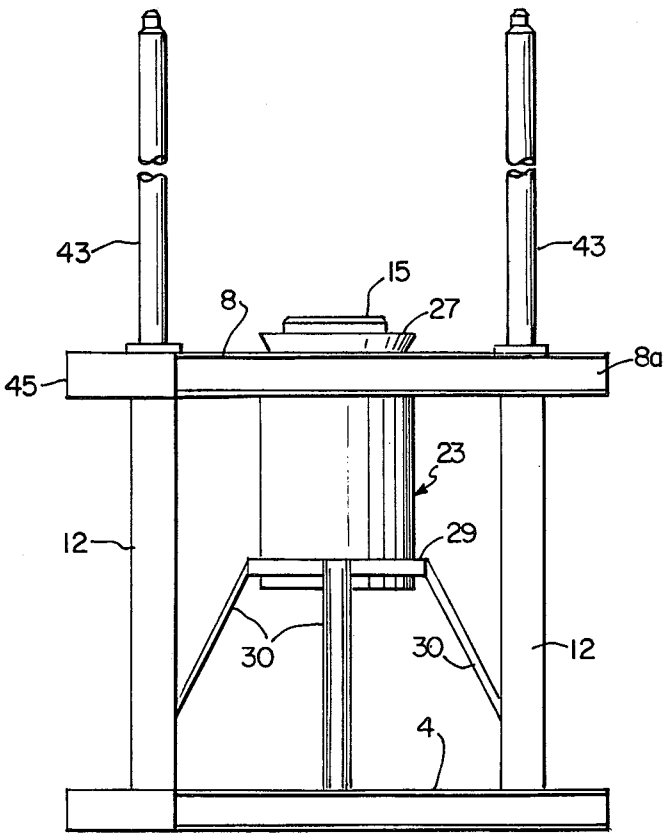
FIG. 6 is an end elevational view of the template module of FIG. 4.

All of the template modules 1 are essentially identical and, as seen in FIGS. 4–6, each module 1 comprises a rigid frame 3 which is in the form of an elongated rectangle when viewed in side elevation or plan elevation and is rectangular in end elevation. The entire frame can be constructed of heavy steel I-beam stock and includes a lower or base portion made up of end members 4 and 5 and side members 6 and 7. Frame 3 further comprises a top portion made up of end members 8 and 9 and side members 10 and 11. The bottom and top frame portions are rigidly interconnected by upright members 12, FIG. 4, located one at each corner of the frame. Rigidly connected between side members 10 and 11 at the top of the frame is the combination of I-beam cross braces 13 and 14 and an upright connector body or hub 15, braces 13 and 14 being mutually aligned and at right angles to the side members and spaced from end member 8 by a distance such that member 8 and braces 13, 14 define two parallel sides of a square. Connector hub 15 is located midway between side members 10 and 11. At the bottom of the frame, side members 6 and 7 are interconnected by a cross brace 16, visible in FIG. 2, which is aligned below braces 13 and 14. At the other end of the frame, upper side members 10 and 11 are rigidly interconnected by the combination of cross braces 17 and 18 and a second connector hub 19. A cross brace 20, FIG. 2, interconnects side members 6 and 7 and is aligned vertically with braces 17 and 18. Braces 17 and 18 are spaced from end member 9 so that member 9 and braces 17, 18 define two parallel sides of a square. In the location of braces 13 and 14, lower side members 6 and 7 and upper side members 10 and 11 are respectively interconnected rigidly by vertical members 21. Vertical members 22 are similarly provided at the respective ends of braces 17 and 18.

Each template module 1 is also equipped with two devices, indicated generally at 23 and 24, each of which serves both as a collar for locating a well to be drilled and as a support for the outer casing (not shown) of the well preparatory to cementing. Combined well-locating and casing-support devices 23 and 24 are identical and only device 23 will be described. Device 23 comprises a collar 25, FIG. 7, rigidly supported on frame 3 of module 1 by I-beam braces 26 each having one end welded to collar 25 and the other end welded respectively to one of the junctions between members 8, 13 and 14, on the one hand, and side members 10 and 11, on the other hand, as seen in FIG. 5. A guide funnel 27 is welded to the upper end of collar 25. A relatively short tubular member 28 has its upper end welded to the lower end of collar 25 and depends therefrom, the outer diameter of member 28 equalling that of the collar and member 28 being coaxial with the collar. A square support frame 29 is welded to the outer surface of member 28 near the bottom end of that member and is rigidly supported on the bottom frame portion of module 1 by four channel members 30.

Figure 7:
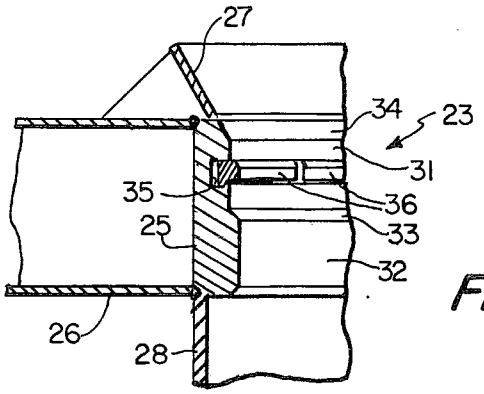
FIG. 7 is a fragmentary vertical sectional view, enlarged relative to FIG. 5, taken generally on line 7—7, FIG. 5.

As seen in FIG. 7, the bore of collar 25 includes a portion 31 of larger diameter and, therebelow, a portion 32 of smaller diameter, these two portions being joined by a downwardly and inwardly tapering frusto-conical support shoulder 33. At the upper end of bore portion 31, a frusto-conical downwardly and inwardly tapering portion 34 is provided as a continuation of the inner surface of guide funnel 27. Bore portion 31 is interrupted by a transverse annular inwardly opening groove 35 which accommodates a circular series of conventional latching segments 36 which are urged inwardly by springs (not shown).

Figure 8:
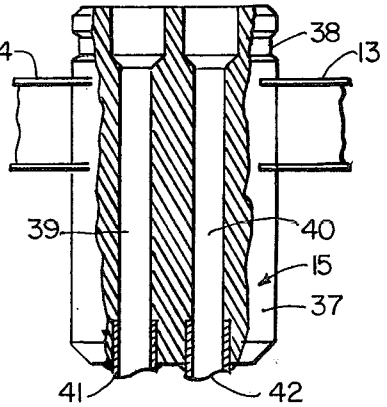
FIG. 8 is a fragmentary view, partly in side elevation but with portions broken away for clarity of illustration, showing a flowline landing hub employed in the template module of FIGS. 4–6.

Connector hubs 15 and 19 are identical and only hub 15 will be described. The connector hub comprises a cylindrical body 37, FIG. 8, which is rigidly supported on frame 3 by being welded to cross braces 13, 14. Near its upper end, body 37 is provided with a transverse annular outwardly opening locking groove 38. For a dual string well, body 15 is provided with two parallel through bores 39, 40 which are enlarged at their upper ends to receive connector sleeves (not shown) carried by the flowline connector. The lower ends of bores 39, 40 are enlarged to accommodate outlet tubing portions 41 and 42, respectively, which are inserted and welded to body 37.

Each template module 1 is provided with four upright guide posts 43, FIGS. 4 and 5, rigidly mounted on the upper frame portion each at a different corner of the square defined by end member 8, cross braces 13, 14 and the portions of side members 10 and 11 between the end member and the cross braces. Similarly, each template module 1 is provided with four upright guide posts 44 each located at a different corner of the square defined by end member 9, cross braces 17, 18 and the portions of side members 10 and 11 between end member 9 and cross braces 17, 18. It will be understood that the four guide posts 43 can be used as the guide posts for a conventional guidance system of the type disclosed in U.S.

Pat. No. 2,808,229, issued Oct. 1, 1967, to Bauer et al and that the guidance system, extending downwardly from the surface vessel to the template structure, will serve in known fashion to guide drilling and completion equipment into place with respect to device 23 and connector hub 15. Guide posts 44 similarly serve to guide drilling and completion equipment into place with respect to device 24 and connector hub 19.

Template modules 1 and riser base module 2 are fabricated as independent units at a suitable fabricating facility and shipped as independent units to an assembly yard or equipment mobilization center convenient to the site at which wells are to be drilled. The desired number of template modules and the riser base module are then joined rigidly together to form the assembly seen in FIG. 1. That assembly is then conveyed to the offshore drilling site, as by barge or by attaching flotation equipment and towing the assembly.

As will be clear from FIGS. 4–6, the template modules are so constructed as to be easily fitted together and joined rigidly by pinning and welding. At the end of member 8, side member 10 carries two outwardly projecting plates 45 which are parallel, lie in vertical planes and are spaced apart to snugly accommodate a section of I-beam of the size of member 8. Two plates 46 are similarly carried by member 10 at the outer end of cross brace 17. At the outer end of cross brace 13, a short piece of I-beam 47 projects from member 10. End member 9 projects at 9*a*, beyond side member 10. At the bottom of the module, side member 6 is equipped with plates identical to plates 45 and 46 and with I-beam portions identical to elements 47 and 9*a*. At the other side of the template module, end member 8 is extended beyond side member 11 to provide projecting portion 8*a*. Pairs of plates 48 and 49 are provided on member 11 at the ends of cross brace 14 and end member 9, respectively. A projecting I-beam portion 50 is provided at the end of cross brace 18. Lower side member 7 is provided with elements identical to elements 8*a*, 48, 49 and 50. It is thus apparent that two of the modules 1 can be fitted together side-by-side, with, e.g., elements 8*a* and 50 of one module received respectively between the pairs of plates 45 and 46 of the other module, and with the pairs of plates 48 and 49 respectively accommodating the I-beam portions 47 and 9*a* of that member. Thus, in effect, a joint between the two modules is provided, in the location of each of the transverse frame members, by pinning and welding an I-beam portion, such as portion 8*a*, between a pair of plates, such as plates 45.

Referring again to FIG. 1, riser base module 2 is encased, but can be constructed with a frame of I-beam stock adapted to be rigidly secured to one of the template modules 1 in the same fashion just described with reference to securing the two template modules together. The riser module includes at least connector hubs 51, for connection of riser conduits to the respective flowlines of the wells, the large diameter connector hub 52 communicating with the off-bearing pipe line 53, and a plurality of connector hubs 54 for connection of control bundles to the riser base module. Considering FIGS. 1, 2 and 4, it will be apparent that the space between upright frame members 21 and 22 in the template modules accommodates the piping 55 between the flowline connector hubs 15, 19 and the respective connector hubs 51 of the riser base module. When, at the assembly yard or mobilization center, the template modules 1 and riser base module 2 have been joined together, all of the necessary piping is installed. The entire assembly is then moved to the drilling site and lowered into direct contact with the floor of the body of water. Levelling of the structure is accomplished as hereinafter described.

Drilling of the wells is then carried out in conventional fashion, and when each well has been drilled and wellhead body 63 is in place, the Christmas tree for that well is installed in the manner shown in FIG. 2. With guide lines 56 extending from the four guide posts 43 centered on the device 23 through which the well was drilled, the tree assembly indicated generally at 57 is lowered along the guide lines. Assembly 57 includes a base 58 which carries both the tree 59 and a flowline connector 60, connector 60 being connected by flow conduits 61 to the tree. At each corner, base 58 is provided with a guide sleeve 62 which embraces one of the guide lines as the tree is lowered and which, during landing of the tree assembly, telescopes over the corresponding guide post 43 to locate the base 58, and thus the tree and the flowline connector 60, precisely with respect to the wellhead body 63 and flowline connector hub 15. Both the flowline connector 60 and the connector for the tree 59 are conventional remotely operated devices and can be, for example, of the type described in U.S. Pat. No. 3,228,715, issued Jan. 11, 1966, to Neilon et al. When tree assembly 57 has been landed, the tree has been connected to wellhead body 63, and connector 60 has been connected to hub 15, the flow conduits of the tree assembly are in communication with the respective connector hubs 51 of the riser base module 2.

For simplicity of illustration, the apparatus shown in FIGS. 1–3 embodies only two template modules 1 and therefore is useful where only four wells are to be drilled. Drilling can be directional for all or only some of the wells, and is advantageously carried out from the same surface vessel to be employed as the production station. Drilling of the four wells is carried out successively, a separate set of guide posts 43, 44 being provided for each locator device 23, 24. Conventional underwater drilling and completion procedures are continued until all four wells have been drilled and all four Christmas tree assemblies are in place, as seen in FIG. 3.

Employing four conventional guide posts 65, mounted on riser base module 2, and guide lines 66, a production riser assembly 67 is installed. Riser assembly 67 comprises a manifold base 68, manifold 69, a universal joint base 70 which may also form part of the manifold structure, universal joint 71, and an assembly of riser conduits indicated generally at 72. Installation of the riser assembly places each well in communication with the surface vessel, used as the production station, such communication being via conduits 61 of the tree assembly, connector 60, hub 15, the respective pipes 55, the corresponding connector hubs 51, and the appropriate conduits of assembly 72. Control bundles 73, FIG. 3, can be connected to hubs 54, FIG. 1, either before the structure is submerged or as part of the system guided into place with manifold base 68.

Figure 10:
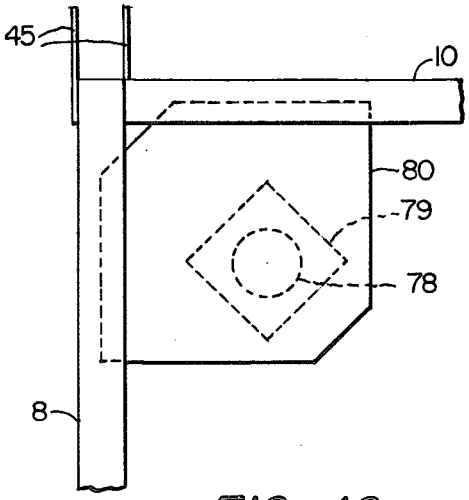
FIG. 10 is a fragmentary top plan view in the location of the levelling leg when the same is incorporated in the template module of FIGS. 4–6.
Figure 9:
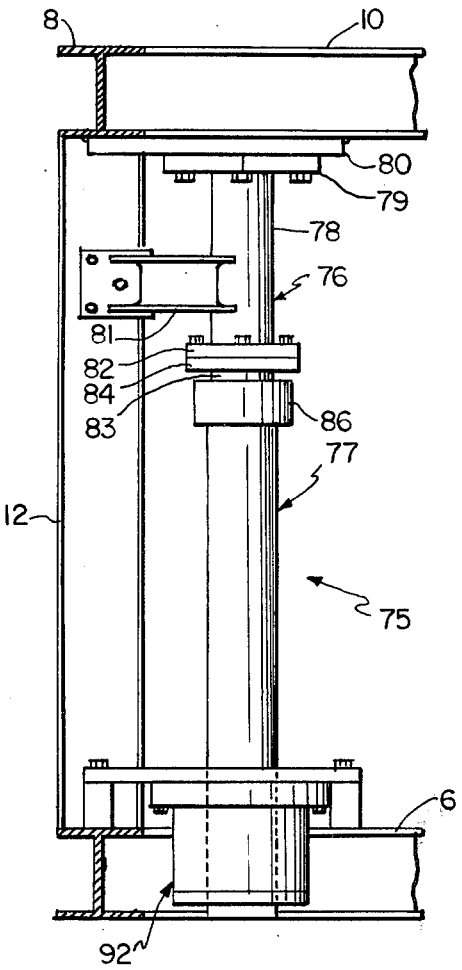
FIG. 9 is a fragmentary side elevational view of a remotely adjustable levelling leg which can form part of the apparatus of FIGS. 1–3.
Figure 11:
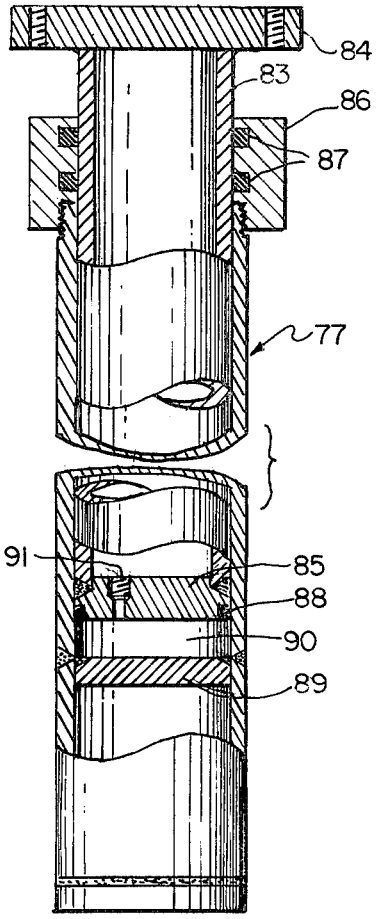
FIG. 11 is a vertical sectional view of a portion of the levelling leg of FIG. 9.

The apparatus shown in FIG. 1 is intended to be landed directly on the ocean floor, or other underwater floor, and the apparatus is rigidly fixed in place by cementing the outer casing for each well. When the bottom on which the apparatus is to be landed is uneven and levelling is required, remotely adjustable levelling legs 75, FIGS. 9–11, are provided one at each corner of each template module 1 or one at each outer corner of the assembly of template modules. Legs 75 are identical, each comprising an elongated upright inner member 96 which is rigidly secured to the frame of one of the template modules 1, and a movable outer cylinder 77 which surrounds member 76 and extends downwardly therefrom. Member 76 comprises an upper portion 78 having at its upper end a transverse flange 79 bolted to a plate 80 which is welded to, e.g., upper side member 10 and end member 8 adjacent the juncture of members 8 and 10. A brace 81 has one end secured to portion 78 in a location spaced below flange 79, the other end of brace 81 being secured to the adjacent upright frame member 12. At its bottom end, portion 78 has a second transverse flange 82. Member 76 is completed by an elongated lower portion 83 in the form of a heavy wall tube closed at its top by a transverse flange plate 84 which is bolted to flange 82. At its lower end, portion 83 is closed by a circular closure plate 85, FIG. 11.

Outer cylinder 77 is substantially longer than portion 83 of member 76 and is externally threaded at its upper end for attachment to an annular ring 86. Ring 86 and the tubular main body of member 77 have a common internal diameter which is only slightly larger than the outer diameter of portion 83 of member 76. Ring 86 has two inwardly opening transverse annular grooves accommodating seal rings 87. Closure plate 85 has a transverse annular outwardly opening groove accommodating a seal ring 88.

At a point spaced from ring 86 by a distance slightly less than the length of portion 83 of member 76, member 77 is provided with a transverse partition 89 which is welded to the tubular wall of the main body of member 76 so as to seal thereacross and establish an expansible chamber 90 between plate 85 and partition 89. Hydraulic fluid from a pressure source, either in riser base module 2 or at the surface vessel, is supplied to chamber 90 via a suitable valve-controlled hydraulic line (not shown) connected to a port 91 in plate 85.

As seen in FIG. 9, the lower end portion of member 77 extends through a leg locking mechanism 92 which is rigidly mounted on the adjacent bottom members of the template module 1 and serves to lock leg 75 rigidly to the frame once levelling has been accomplished. Locking mechanism 92 can, for example, comprise an annular set of slip segments having serrated arcuate faces engaging member 77, the segments being disposed in a frusto-conical bowl which is fixed to the housing of the locking mechanism, and thus to the template module frame, and which tapers upwardly and inwardly so that the weight of the template module acts to energize the slips.

To accomplish levelling remotely, the position of the assembly is observed by using an underwater television camera viewing a bubble level. Depending upon that observation, appropriate ones of legs 75 are extended hydraulically until it is observed that the assembly is level.

What is claimed is:

1. In an underwater apparatus for use in drilling, completing and producing a plurality of wells, the combination of at least one drilling and production template module comprising a rigid frame adapted to be installed on the floor of a body of water before the wells are drilled, two sets of guide posts rigidly mounted on the frame in two horizontally spaced locations and extending upwardly therefrom to cooperate with guide means extending upwardly to an operational base at the surface of the body of water, two upright tubular well-locating and casing-support devices mounted on said frame each in a predetermined location with respect to a different one of said sets of guide posts, and two flowline connector bodies mounted on said frame, one of said flowline connector bodies occupying a first location near and spaced laterally from one of said locating and support devices, the other of said flowline connector bodies occupying a second location near and spaced laterally from the other of said locating and support devices;

a riser module rigidly secured to the frame of said at least one drilling and production module for installation therewith and comprising a plurality of upwardly exposed riser flowline connector hubs, and a set of guide posts fixed on the riser base module in predetermined positions relative to the riser flowline connector hubs to cooperate with guide means extending upwardly to the operational base at the surface of the body of water; and conduit means communicating between respective ones of the flowline connector bodies of the drilling and production template and the riser flowline connector hubs.

2. The combination defined in claim 1, wherein the apparatus comprises a plurality of drilling and production template modules;

said frames of the drilling and production template modules are elongated horizontally, disposed side-by-side and secured rigidly together, said well-locating and casing-support devices of each of the drilling and production template modules are spaced apart lengthwise of the elongated frame of the respective module;

the riser base module is disposed beside one of the drilling and production template modules and secured rigidly thereto; and the conduit means communicating between the flowline connector bodies and the riser flowline connector hubs extends transversely through the frames of the drilling and production template modules.

3. The combination defined in claim 2, wherein the flowline connector bodies of each drilling and production template module are spaced apart lengthwise of the frame of the respective module and located between the well-locating and casing-support devices carried by that frame; and the conduit means communicating between the flowline connector bodies and the riser flowline connector hubs are confined to a transverse area extending between the adjacent pairs of flowline connector bodies.

4. The combination defined in claim 1, further comprising wellhead means for a well drilled through one of said well-locating and casing-support devices, said wellhead means comprising a wellhead body aligned with and projecting upwardly from said one well-locating and casing-support devices; and a Christmas tree assembly connected to said wellhead body and including a base having guide sleeves engaged respectively with the set of said guide posts associated with said one well-locating and casing-support device, a tree body carried by said base, a flowline connector carried by said base, and conduit means interconnecting the tree body and the flowline connector, said flowline connector being coupled to the corresponding one of said flowline connector bodies.

5. The combination defined in claim 1, wherein said riser base module further comprises lateral connector means for connection to an offbearing product pipe line, and an upwardly exposed riser return connector hub communicating with said lateral connector.

6. The combination defined in claim 1 and further comprising a plurality of levelling legs secured to the at least one drilling and production module for levelling the apparatus remotely, each of said legs comprising two upright members telescopically engaged to provide a hydraulically extendable leg structure, the uppermost one of said two upright members being secured to the frame of the module and the lowermost one of said two upright members projecting below the bottom of the frame when the leg structure is extended, and means for locking the lowermost one of said two upright members to the frame of the module when the apparatus has been levelled.

7. The combination defined in claim 1, wherein each of said well-locating and casing-support devices comprises an annular collar having a transverse annular upwardly directed support shoulder, upper brace means securing said collar to said frame, an upright tubular member having its upper end secured to said collar, the body of said tubular member depending from said collar, and lower brace means securing the body of said tubular member to said frame.

* * * * *